US005713962A

United States Patent [19]

Scialla et al.

[11] Patent Number: 5,713,962

[45] Date of Patent: Feb. 3, 1998

[54] PROCESS FOR THE BLEACHING OF FABRICS

[75] Inventors: Stefano Scialla; Raffaele Scoccianti, both of Rome, Italy; Andrea Soddu, Uccle, Belgium; Alan David Willey, Cincinnati, Ohio

[73] Assignee: The Procter & Gamble Company, Cincinnati, Ohio

[21] Appl. No.: 557,018

[22] PCT Filed: May 24, 1994

[86] PCT No.: PCT/US94/05817

§ 371 Date: Feb. 20, 1996

§ 102(e) Date: Feb. 20, 1996

[87] PCT Pub. No.: WO94/29509

PCT Pub. Date: Dec. 22, 1994

[30] Foreign Application Priority Data

Jun. 9, 1993 [EP] European Pat. Off. ..... 93870102

[51] Int. Cl.[6] ..... D06L 3/02; D06L 3/16

[52] U.S. Cl. ..... 8/111; 8/107; 510/302; 510/303; 510/309; 510/312; 510/336; 510/337; 510/372; 252/186.38; 252/186.41

[58] Field of Search ..... 8/111, 107; 252/94, 252/95, 186.38, 186.41, 186.42; 510/302, 303, 309, 312, 336, 337, 372

[56] References Cited

U.S. PATENT DOCUMENTS

| | | | |
|---|---|---|---|
| 3,833,721 | 9/1974 | Saute et al. | 424/47 |
| 4,010,253 | 3/1977 | Reese et al. | 424/47 |
| 4,120,650 | 10/1978 | Kappler et al. | 8/109 |
| 4,292,192 | 9/1981 | Hooper et al. | 510/133 |
| 4,412,934 | 11/1983 | Chung et al. | 59/78 |
| 4,557,935 | 12/1985 | Ekenstam et al. | 424/130 |
| 4,786,431 | 11/1988 | Broze et al. | 510/304 |
| 5,071,993 | 12/1991 | Leppard et al. | 548/220 |
| 5,194,250 | 3/1993 | Fairhurst et al. | 424/70 |
| 5,409,632 | 4/1995 | Showell et al. | 510/372 |

FOREIGN PATENT DOCUMENTS

| | | |
|---|---|---|
| 0 598 170 A1 | 11/1992 | European Pat. Off. . |
| WO 93/11869 | 6/1993 | WIPO . |
| WO 93/12067 | 6/1993 | WIPO . |

*Primary Examiner*—Alan D. Diamond
*Attorney, Agent, or Firm*—Robert B. Aylor

[57] ABSTRACT

A process of bleaching fabrics is disclosed where a liquid or pasty composition comprising acetyl triethyl citrate and a source of hydrogen peroxide is applied to fabrics before they are immersed in an aqueous wash liquor.

5 Claims, No Drawings

PROCESS FOR THE BLEACHING OF FABRICS

This application is a 371 of PCT/US94/05817 filed May 24, 1994.

TECHNICAL FIELD

The present invention relates to the bleaching of fabrics and to pretreatment compositions for fabrics.

BACKGROUND

The bleaching of fabrics is extensively discussed in the art. Various bleaching compositions have been designed for this purpose, which can be classified in two classes: peroxide bleaching compositions and hypochlorite bleaching compositions. Peroxide bleaching has the advantage over hypochlorite bleaching that it is generally regarded as safer to the color of fabrics and as non-yellowing on white fabrics.

A major drawback of peroxygen bleaches is that they are less active than chlorine bleaches at low temperatures which are often encountered in modern laundering operations. Thus peroxygen bleach activators have been developed which have been extensively addressed in the art. A particular class of peroxygen bleach activators is constituted by peracid precursors which react with hydrogen peroxide to form peracids which are the activated bleaching species.

Treatments of fabrics before they are washed, often referred to as fabric pretreatments are also known in the art. In these pretreatments, an effective quantity of a given liquid or pasty composition is applied onto a portion of the fabrics, typically the heavily soiled portions, before the fabrics are washed in an aqueous wash liquor.

It has now been found that a particularly effective bleaching of fabrics can be achieved in connection with a pretreatment operation, provided a liquid or pasty composition is used which comprises acetyl triethyl citrate as a peracid precursor.

Acetyl triethyl citrate has been disclosed as a peracid precursor in the context of laundry bleaching in co-pending PCT application US 92-10445.

SUMMARY OF THE INVENTION

The present invention is a process of bleaching fabrics which comprises the steps of applying on at least a portion of said fabrics an effective amount of a liquid or pasty composition comprising acetyl triethyl citrate, then washing said fabrics in an aqueous wash liquor, wherein an effective amount of hydrogen peroxide is provided either in said liquid or pasty composition, or in said wash liquor.

DETAILED DESCRIPTION OF THE INVENTION

The present invention involves the use of a liquid or pasty composition comprising acetyl triethyl citrate. By liquid or pasty, it is meant herein a composition which can be conveniently applied on fabrics before the fabrics are washed. Ideally, the compositions for use in the process of the present invention should not be so thick as to be difficult to apply on fabrics, or so thin as to compromise on the accuracy of the application on the fabrics. Accordingly, suitable compositions for use herein range from thin liquids to gels. Preferred compositions for use herein have a viscosity of from 50 cps to 10000 cps at 50 rpm at 20° C.

As an essential feature of the present invention, the compositions for use herein must comprise an effective amount of acetyl triethyl citrate. Acetyl triethyl citrate is a known chemical which is commercially available for instance under the trade name Citroflex®, available from Morflex, but acetyl triethyl citrate Was only disclosed as a bleach activator for the first time in co-pending PCT application US 92-10445. As discussed therein, acetyl triethyl citrate provides a wide variety of benefits, especially in the context of a liquid bleaching composition where it displays excellent storage stability, compared to the peracid precursors in the art. Furthermore, acetyl triethyl citrate has the peculiarity that it is a substantially water-insoluble liquid peracid precursor which perhydrolyses into a substantially water-soluble peracid. We have now found that this peculiarity makes it particularly advantageous to use acetyl triethyl citrate in the context of the present invention.

Indeed, because it is a substantially water-insoluble liquid peracid precursor, acetyl triethyl citrate tends to affine onto the surface of fabrics and/or stains where it has been applied during the pretreatment operation instead of dissolving in the aqueous wash liquor in which the fabrics are washed, thus promoting surface bleaching instead of solution bleaching, i.e. the perhydrolysis of the acetyl triethyl citrate into peracetic acid occurs on the surface of the fabrics and/or stains instead of in the wash liquor, increasing the overall efficiency of the bleaching process. Thus the affinity between the peracid precursor and the fabric, especially the soiled portions thereof, is maximized. Naturally, this effect is favored when synthetic fabrics are pretreated, as synthetic fabrics have a hydrophobic character.

Accordingly, in the context of the present invention, the bleaching of fabrics does not substantially occur during the pretreatment operation, but rather in the subsequent step where the pretreated fabrics are immersed in an aqueous wash liquor. In other words, the present invention lies not only in the use of acetyl triethyl citrate as a bleach activator, but also in the use of acetyl triethyl citrate in a pretreatment operation, whereby the bleaching of fabrics is optimized in the subsequent step where the fabrics are immersed in an aqueous wash liquor. Accordingly, in its broadest aspect, the present invention encompasses the use of acetyl triethyl citrate for the manufacture of a liquid or pasty composition to be used in the pretreatment of fabrics.

Furthermore, acetyl triethyl citrate is perhydrolysed into peracetic acid which is a substantially water-soluble peracid. Thus the peracid generated promptly dissolves in the wash liquor. Also, triethyl citrate which is the second component produced in perhydrolysis of acetyl triethyl citrate is also water-soluble. Therefore it is another advantage of the present invention that the peracid generated is not permanently affixed to the fabrics, and all perhydrolysis reaction compounds are solubilized in the wash liquor. This benefit translates into an easy rinsing off of the peracid from the fabrics.

Furthermore still, we have found that acetyl triethyl citrate also acts as a substantially water-insoluble solvent which dissolves the stains, thereby preparing and easing the subsequent cleaning of the fabrics in the subsequent step where said fabrics are immersed in said wash liquor. This constitutes another benefit of using acetyl triethyl citrate in the pretreatment mode according to the present invention.

Accordingly, the compositions for use herein comprise from 0.5% to 50% by weight of the total composition of acetyl triethyl citrate, preferably from 2% to 20%. As regards the amounts of ingredients in the present invention, the expression effective amount refers to amounts of acetyl triethyl citrate and hydrogen peroxide which will ensure the bleaching of fabrics.

In the process according to the present invention, it is essential that hydrogen peroxide be supplied so that acetyl triethyl citrate is perhydrolysed into peracetic acid. Hydrogen peroxide can be supplied either in the pretreatment composition, i.e. together with acetyl triethyl citrate, or in the wash liquor. Most conveniently, hydrogen peroxide is provided by the pretreatment composition. Also, it is to be understood that hydrogen peroxide can be supplied directly as hydrogen peroxide or indirectly, as sources of hydrogen peroxide such as perborate, percarbonate and the like. Accordingly, in a preferred embodiment of the present invention, the pretreatment compositions suitable for use herein comprise from 0.5% to 30% by weight of the total composition of hydrogen peroxide, preferably from 2% to 20%. In this preferred embodiment, and in order to ensure optimum chemical stability for the compositions herein, it is desirable to formulate pretreatment compositions in the mildly acidic range, from pH 1 to 6, preferably 3 to 5.

In order to make best use of the pretreatment step in the process herein, the compositions suitable for use herein may further comprise a variety of optional ingredients. Preferred optional ingredients include surfactants, such as described in the art, at a total level of from 4% to 85% by weight of the total composition, preferably from 8% to 60%. Preferred surfactants for use herein are anionic and nonionic surfactants, typically alkyl benzene sulphonates and fatty alcohol ethoxylates. Other suitable optional ingredients include builders, enzymes, soil release agents, dyes, opacifiers, perfumes and other minors.

As acetyl triethyl citrate is water-insoluble, it is particularly advantageous to formulate a composition comprising it in the form of an aqueous emulsion of at least two nonionic surfactants, a hydrophilic one and a hydrophobic one, having different HLB values, and the difference in HLB value is of at least 3. Nonionic surfactants with different HLBs can be conveniently chosen by selecting alkoxylated alcohols with varying degrees of alkoxylation. Such compositions typically comprise from 10% to 95% by weight of the total composition of water, preferably deionized, preferably from 60% to 80%. For optimum stability, and when the compositions comprise hydrogen peroxide, it is preferred to formulate at pH 0.5 to 6. These compositions, which have been described more extensively in co-pending application EP 92870188.7, allow to formulate physically and chemically stable liquid compositions which may further comprise hydrogen peroxide.

In the process according to the present invention said liquid or pasty composition comprising acetyl triethyl citrate as described hereinbefore is applied on at least a portion of said fabrics, and said fabrics are subsequently immersed in an aqueous wash liquor. Indeed, it is essential that acetyl triethyl citrate is applied to the fabrics before said fabrics are immersed in an aqueous wash liquor so that acetyl triethyl citrate is affined in an optimum manner to fabrics.

The only critical aspect of the wash liquor herein is that it should provide an aqueous medium which has a pH of above 6. Indeed, such a pH is essential in order to trigger the perhydrolysis reaction- Optionally, but preferably, said wash liquor further comprises from 0.5 g/l to 20 g/l of common detersive ingredients which are well known in the art, including surfactants, builders, soil release agents, enzymes, bleaching components and the like. Suitable wash liquors are suitably provided by using conventional and commercially available laundry detergents in recommended dosage, either in hand wash or in machine wash. The present invention is not limited to either washing mode.

In a preferred embodiment of the present invention, the pretreatment composition is left on the fabrics for a certain period of time, typically about 2 min to 20 min before said fabrics are immersed in the wash liquor. Such an embodiment ensures that acetyl triethyl citrate is affined to fabrics in an optimum manner, and other ingredients in said pretreatment composition, if any, may perform as well.

EXAMPLE

The present composition is used as a pretreater which comprises the following ingredients in the following amount.

Example 1

A following composition is used as a pretreater which comprises the listed ingredients in the listed proportions.

| | |
|---|---|
| Dobanol 91–10® | 5.0% |
| Dobanol 23–2® | 8.0% |
| Acetyl triethyl citrate | 6.0% |
| H202 | 7.5% |
| Citric acid | up to pH 4 |
| Water and minors | up to 100% |

This composition is applied onto soiled fabrics and left to act for 10 min. Subsequently, the fabrics are washed in a "San Giorgio® Ghibli 6" model washing machine, set on 40° C., together with 180 ml of a liquid detergent composition commercialized under the trade name Ariel® Liquid.

Example 2

A following composition is used as a pretreater which comprises the listed ingredients in the listed proportions.

| | |
|---|---|
| Dobanol 45–7@ | 6.0% |
| Dobanol 91–10@ | 3.0% |
| Dobanol 23–2@ | 6.0% |
| Acetyl triethyl citrate | 10.0% |
| Citric acid | up to pH 4 |
| Water and minors | up to 100% |

This composition is applied on soiled fabrics and left to act for 15 min. Subsequently, the fabrics are washed in a "Rex® mod. R 35" model washing machine, set on 55° C., with 150 g of a powdered detergent composition commercialized under the trade name Dash ® which comprises perborate bleach.

What is claimed is:

1. A process of bleaching fabrics which have soiled portions, wherein said process comprises the steps of:

applying on at least a portion of said fabrics a liquid or pasty composition comprising acetyl triethyl citrate in an amount sufficient to activate hydrogen peroxide bleach; said composition having a pH of from 1 to 6 and the amount of acetyl triethyl citrate being from 0.5% to 50% of said composition, then immersing said fabrics in an aqueous wash liquor having a pH above 6;

and wherein from 0.5% to 30% hydrogen peroxide is provided in said liquid or pasty composition.

2. A process according to claim 1 wherein said composition is applied to soiled portions of said fabrics.

3. A process according to claim 1 wherein said composition is on said fabrics for about 2 minutes to 20 minutes before said fabrics are immersed in said wash liquor.

4. The process of claim 3 wherein said composition is on said fabrics for about 2 to 10 minutes before said fabrics are immersed in said wash liquor.

5. The process of claim 1 wherein said hydrogen peroxide is present in said composition at from 2% to 20% by weight.

* * * * *